US009656114B1

(12) United States Patent
Hafeez-Bey

(10) Patent No.: US 9,656,114 B1
(45) Date of Patent: May 23, 2017

(54) JAW-STRENGTHENING DEVICE

(71) Applicant: Jamal Hafeez-Bey, Columbus, OH (US)

(72) Inventor: Jamal Hafeez-Bey, Columbus, OH (US)

( * ) Notice: Subject to any disclaimer, the term of this patent is extended or adjusted under 35 U.S.C. 154(b) by 0 days.

(21) Appl. No.: 14/963,634

(22) Filed: Dec. 9, 2015

(51) Int. Cl.
*A63B 23/03* (2006.01)
*A63B 21/008* (2006.01)
*A63B 71/08* (2006.01)

(52) U.S. Cl.
CPC ..... *A63B 21/0085* (2013.01); *A63B 23/032* (2013.01); *A63B 71/085* (2013.01)

(58) Field of Classification Search
CPC ..... A63B 21/00058; A63B 21/00061; A63B 21/00065; A63B 21/00072; A63B 21/00076; A63B 21/00178; A63B 21/00181; A63B 21/00185; A63B 21/008; A63B 21/0083; A63B 21/0085; A63B 21/0087; A63B 21/02; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/06; A63B 21/0602; A63B 21/065; A63B 21/068; A63B 21/08; A63B 21/15; A63B 21/159; A63B 21/4023; A63B 21/4025; A63B 21/4039; A63B 21/4045; A63B 21/4047; A63B 21/4049; A63B 23/025; A63B 23/03; A63B 23/032; A63B 23/18; A63B 23/185; A63B 69/0057; A63B 69/0059; A63B 71/08; A63B 71/081; A63B 71/085; A63B 2071/086; A63B 2225/09; A63B 2225/093; A63B 2225/096; A63B 2225/62
See application file for complete search history.

(56) References Cited

U.S. PATENT DOCUMENTS 1,851,865 A * 3/1932 Ptacek ..... A63B 23/032 433/25
3,091,237 A * 5/1963 Skinner ..... A61H 9/0078 128/DIG. 20
3,380,446 A * 4/1968 Martin ..... A61B 5/103 134/184
3,447,534 A * 6/1969 Lubit ..... A63B 23/032 601/151

(Continued)

*Primary Examiner* — Loan H Thanh
*Assistant Examiner* — Gary D Urbiel Goldner
(74) *Attorney, Agent, or Firm* — Garrett James O'Sullivan

(57) ABSTRACT

A jaw-strengthening device has a first receiver that receives a first row of teeth having first and second molar sections, a first air chamber within the first receiver positioned in a first molar section of the first receiver, a second air chamber within the first receiver positioned in a second molar section of the first receiver, and an egress valve, that permits egress and prevents ingress of air, in communication with the first and second air chambers, a second receiver that receives a second row of teeth having first and second molar sections, a third air chamber within the second receiver positioned in a first molar section of the second receiver, a fourth air chamber within the second receiver positioned in a second molar section of the second receiver, and an ingress valve in communication with the third and fourth air chambers.

9 Claims, 4 Drawing Sheets

(56) References Cited

U.S. PATENT DOCUMENTS 3,710,780 A * 1/1973 Milch ..... A63B 23/18 482/13
3,798,774 A * 3/1974 Stuart ..... A61C 19/045 433/69
4,305,387 A * 12/1981 Reist-Kundig ... A61M 16/0488 128/202.28
4,560,351 A * 12/1985 Osborne ..... A61C 19/063 433/215
5,293,880 A * 3/1994 Levitt ..... A63B 71/085 128/861
5,501,646 A * 3/1996 Miller ..... A63B 23/025 482/10
5,855,535 A * 1/1999 Shafer ..... A63B 23/032 128/861
6,241,521 B1 * 6/2001 Garrison ..... A61B 1/24 433/140
7,476,180 B1 * 1/2009 Cobb ..... A63B 21/0004 482/11
8,702,569 B2 * 4/2014 Martin ..... A63B 21/023 482/11
9,180,336 B2 * 11/2015 Mohammed ..... A63B 23/032
2007/0037116 A1 * 2/2007 Knutson ..... A61C 9/0006 433/68
2007/0151567 A1 * 7/2007 Maurello ..... A63B 71/085 128/859
2010/0006109 A1 * 1/2010 McGinnis ..... A63B 71/085 128/861
2011/0212811 A1 * 9/2011 Rutten ..... A63B 21/00069 482/13
2012/0000472 A1 * 1/2012 Martucci ..... A61M 16/0488 128/861
2012/0279506 A1 * 11/2012 Thompson ..... A63B 71/085 128/861
2012/0283069 A1 * 11/2012 Martin ..... A63B 23/032 482/11
2013/0087157 A1 * 4/2013 Hawkins ..... A63B 71/085 128/859
2015/0133269 A1 * 5/2015 Landis ..... A63B 23/032 482/11
2015/0231443 A1 * 8/2015 Halliday ..... A63B 23/18 482/13
2015/0258417 A1 * 9/2015 Rodgers ..... A63B 71/085 128/861
2016/0256762 A1 * 9/2016 Tucker ..... A63B 71/081
2016/0263465 A1 * 9/2016 Kennedy ..... A63B 71/085

* cited by examiner

JAW-STRENGTHENING DEVICE

BACKGROUND OF THE INVENTION

1. Field of Invention

The present invention relates to the field of mouth guards and jaw-strengthening devices.

2. Description of Related Art

Humans have the need for a strong jaw for athletics, in addition to appearance. Toned jaw muscles help tighten the facial skin and define the jawline. Jaw muscles also impact the ability eat harder foods without discomfort or strain. Jaw exercises may also help with temporomandibular joint (TMJ) dysfunction. The TMJ is surrounded by a series of muscles that control the movement of the lower jaw relative to the upper jaw. On closing, the masseter, anterior and middle temporalis, medial pterygoid, and superior head lateral pterygoid muscles are activated. To open the joint again, the inferior head of lateral pterygoid, anterior digastric and mylohyoid muscles play a part.

There have been many devices created to strengthen the jaw, from rubber inserts that are pressed on with the teeth in order to strengthen the closing of the TMJ, to springs and other resistance attached to orthodontics, to strengthen the opening of the TMJ. Typically the latter are used in conjunction with alignment rods to retrain the movement of the upper and lower jaw relative to one another, to improve orthodontic treatment and jaw alignment over time. Resistance means such as springs may be present between the upper and lower jaw such that compressive force is required to close the jaw, strengthening the closing muscles.

There are drawbacks in the prior art, however, as springs and other metal components may cause harm to the inside of the user's mouth, and alignment rods require braces to be installed on the teeth. Many of the resistance means are set, such that the amount of resistance is not variable.

Based on the foregoing, there is a need in the art for a jaw strengthening device that has no exposed components which may injure the mouth, and which may be inserted and removed as desired in order to perform jaw strengthening exercises. Furthermore, the ability to vary the resistance has the benefit of allowing the user to increase the intensity of the exercise.

SUMMARY OF THE INVENTION

A jaw-strengthening device has a first receiver configured to receive a row of teeth having first and second molar sections, the first receiver having a first air chamber within the receiver positioned in a first molar section, a second air chamber within the receiver positioned in a second molar section, and an egress valve, configured to permit egress of air and prevent ingress of air, in communication with the first and second air chambers, a second receiver configured to receive a second row of teeth, the second receiver having a third air chamber within the receiver positioned in a first molar section, a fourth air chamber within the receiver positioned in a second molar section, and an ingress valve, configured to permit ingress of air and prevent egress of air, in communication with the third and fourth air chambers, wherein the first and third air chambers are in communication, and wherein the second and fourth air chambers are in communication.

In an embodiment, the device has a lip guard positioned on an outside of the ingress valve, configured to retain a lip and prevent the lip from closing the ingress valve. It may also have a lip guard positioned on an outside of the egress valve, configured to retain a lip and prevent the lip from closing the egress valve. In an embodiment, the egress valve has a plurality of resistance settings wherein the egress air is restricted more for a higher resistance, and restricted less for a lower resistance. The egress valve may have a plurality of holes configured to permit egress of air from the egress valve and a slider configured to selectively cover the holes.

The upper and lower receivers may terminate in rear terminals, wherein the upper and lower receivers are connected at each side at the rear terminals, and air channels pass through the terminals. The air chambers may be resilient and open when no force is applied thereto. The air chambers may form bladders to temporarily retain air. The first and second receivers are molded to fit the rows of teeth. Finally, spring hinges may connect the rear terminals of the first and second receivers, wherein the spring hinge is configured to provide resistance.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
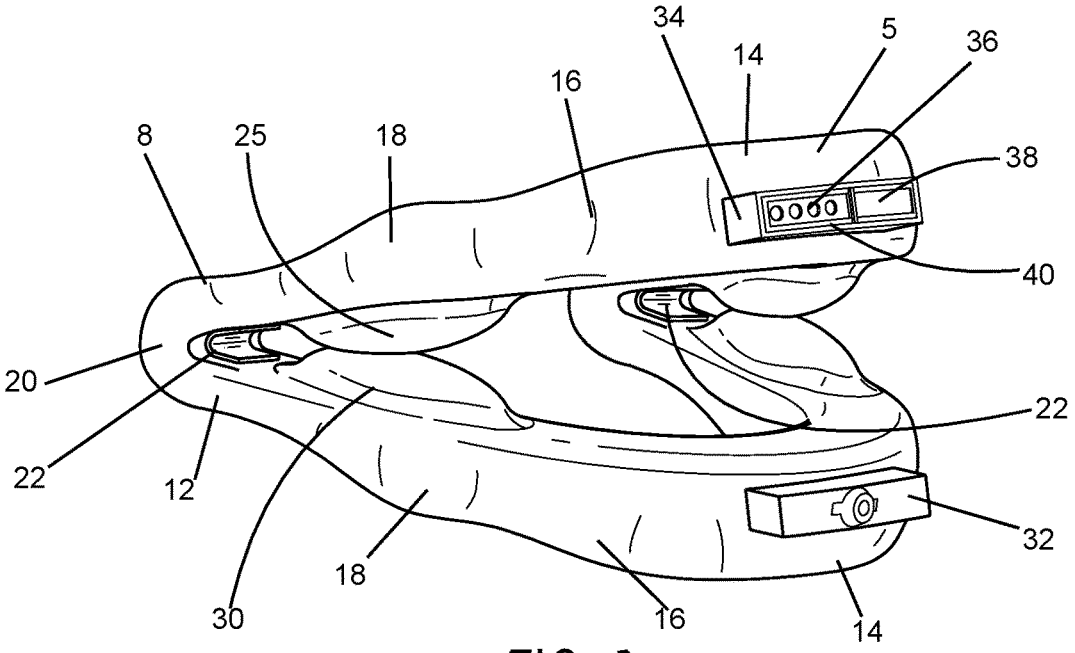
FIG. 1 is a perspective view of the jaw-strengthening device, according to an embodiment of the present invention.

Preferred embodiments of the present invention and their advantages may be understood by referring to FIGS. 1-7, wherein like reference numerals refer to like elements.

With reference to FIG. 1, the jaw-strengthening device has an appearance similar to a mouth guard, and is adapted to be fitted within the mouth. An upper jaw receiver 5 is generally semicircular, terminating at an open rear with a terminal 8 on each side, and has an upper groove 6 (shown in FIG. 5) on the top to accommodate the teeth of the upper jaw. The lower jaw receiver 10 is generally semicircular, has an open rear comprising lower terminals 12, and has a lower groove 11 (not shown) on the bottom to accommodate the lower teeth. The upper and lower jaw receivers 5, 10 have sections generally corresponding to the teeth that are enclosed, namely an incisor section 14 in the front, a canine section 16 and a molar section 18 near the terminals 8, 12. The upper and lower jaw receivers 5, 10 are connected to each other at the terminals by a hinge 20 on each side. In an embodiment, the hinge is an extension of the material of the upper and lower jaw receivers. In another embodiment, the hinge has a spring hinge 22 biasing the strengthener into an open position, wherein a force is required to compress the spring hinge 22 and close the strengthener between the teeth.

Intermediate each of the canine section 16 and the terminals 8, 12 of the upper and lower receivers 5, 10, generally coinciding with the molar section 18 of a row of teeth, are compressible upper air chambers 25 on the upper receiver 5 and lower air chambers 30 on the lower receiver 10. Within the air chambers are bladders 24, 29 (shown in FIG. 3) that retain air. The lower air chambers 30 of the lower receiver are in communication with an lower air channel 26 (shown in FIG. 3) that passes from the lower air chamber 30 through the canine section 16 of each side of the lower receiver 10 and terminates with an air ingress valve 32, a one-way valve that permits the ingress, but not egress, of air. The upper receiver 5 has upper air chambers 25 in communication with an upper air channel 27 (shown in FIG. 3) through the canine section 16 of the upper receiver 5 and terminating in an air egress valve 34, a one-way valve that permits egress, but not ingress, of air. The upper air chambers and lower air chambers are in communication by a terminal air channel 28 (shown in FIG. 3) passing through the hinge at the rear. The air channels are resilient to withstand the compressive forces of the jaw as the air chambers are compressed, in order to prevent the air channels from collapsing.

Other configurations of air chambers may be used. In an embodiment, air chambers are only present either on the upper receiver or on the lower receiver, but not both, wherein the ingress and egress valves are both on the same receiver. In another embodiment, the ingress valve 32 is on the upper receiver 5 and the egress valve 34 is on the lower receiver 10. In another embodiment, the upper receiver 5 or lower receiver 10 has both the ingress and egress valves 32, 34 thereon. So as to prevent the lips from blocking the ingress valve 32, a further lip groove for accommodating the lip may be present below the ingress valve to retain the lower lip and prevent the lip from obstructing the ingress valve. A similar lip groove may be present above the egress valve, but this is not critical as the egress valve will not be substantially blocked by being covered by the lip due to the exiting air flow.

The air chambers have resilience such that they return to an open or inflated position if no force is applied. Depending on the strength of the rubber used, there may be a significant mechanical compression resistance of air chambers as they are compressed in the form of distortion of the air chamber material itself. The rubber composition may be varied to provide greater or less resistance and durability. A harder durometer rubber will provide greater resistance and durability than a softer durometer rubber.

In one embodiment the egress valve has a fixed resistance. In another embodiment the egress valve 34 has variable resistance, such that the air exits the air chamber faster or slower thus decreasing or increasing the resistance, respectively. In an example the adjustable egress valve 34 has a slider 38 and a number of egress ports 36, each sized to permit a certain air flow, wherein the slider rests in a track 40 over the ports 36 and may be slid across to cover all, some or none of the ports thereby varying the resistance of the egress.

The upper 5 and lower receivers 10 may be formed for a particular person's mouth or bite to custom fit the teeth, and may be made of a heat-deformable plastic or rubber to effect a molding to the bite, or from other non-toxic materials known in the art to take and hold a mold of the teeth.

Figure 2:
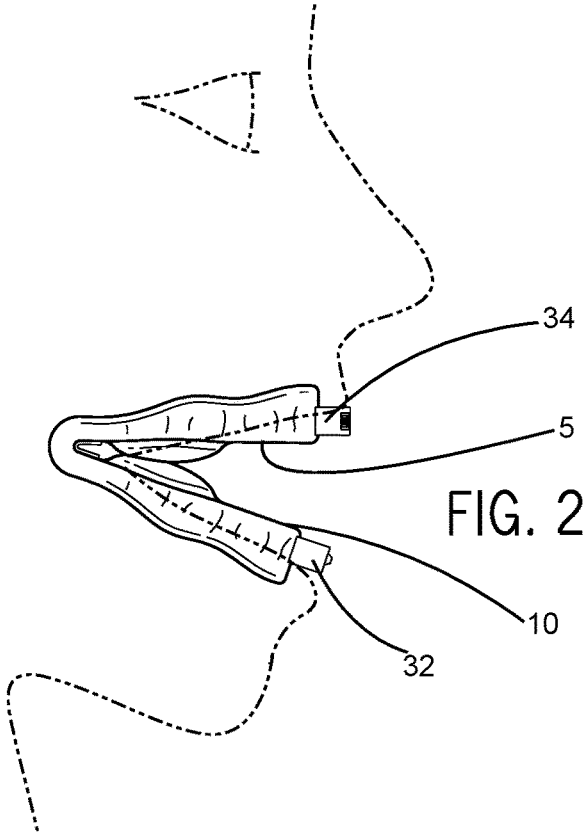
FIG. 2 is a view of the jaw-strengthening device positioned within the mouth, according to an embodiment of the present invention.

With reference to FIG. 2, the jaw-strengthening device is shown within the mouth, wherein the upper and lower grooves (not shown) fit over the upper and lower teeth, respectively, and the ingress valve 32 and egress valve 34 are unblocked by the lips that rest underneath the ingress valve 32 and above the egress valve 34. In another embodiment, the ingress 32 and egress valves 34 are flush with the front of the upper 5 and lower receivers to permit the user to close his or her mouth.

Figure 3:
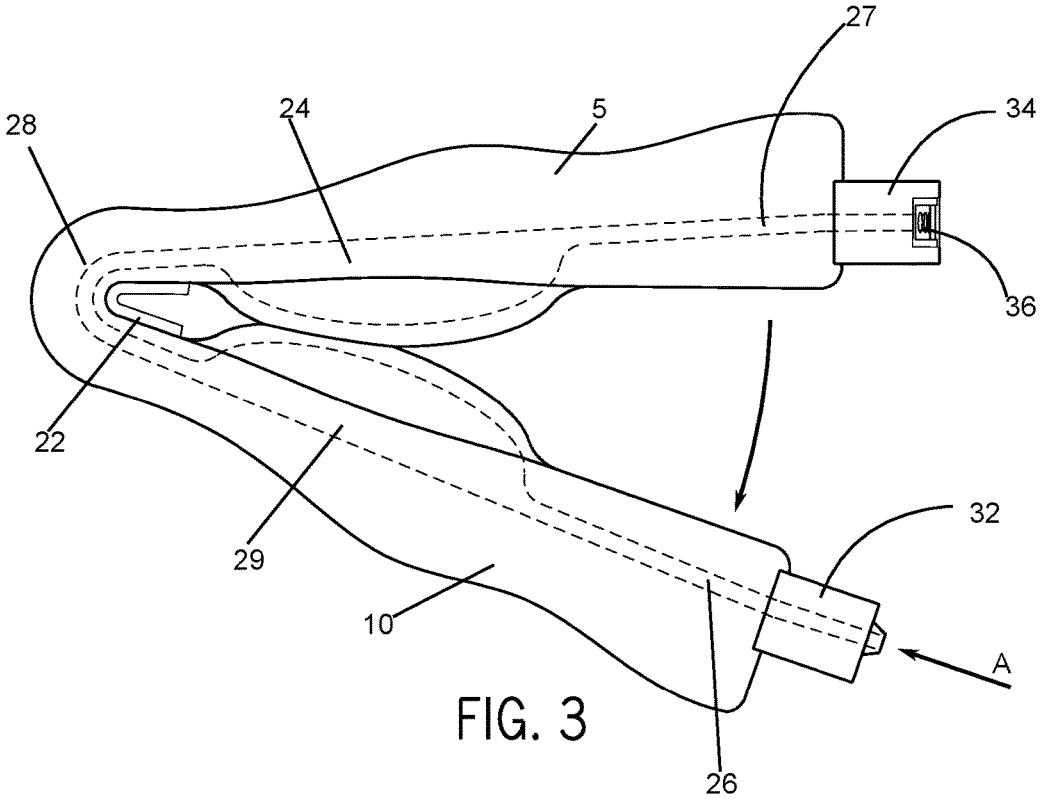
FIG. 3 is a side elevation view of the jaw-strengthening device in an open position, according to an embodiment of the present invention.

With reference to FIG. 3, the jaw-strengthening device is shown in an open position, wherein the mouth of the wearer is open. In this position, the resilient upper bladder 24 and lower bladder 29 expand to their open size, producing an area of low pressure within the bladders 24, 29. The ingress valve 32 draws air in along airflow marked A and through the lower channel 26 as the lower bladder 29 expands, and through the terminal channel 28 as the upper bladder 29 expands. The draw of the expanding bladders 24, 29 pushes aside a flapper (not shown) within the valve 32 to fill the chambers and equalize the pressure. The flapper (not shown) prevents the egress of air through the ingress valve 32. Despite a low pressure within the bladders 24, 29, no air ingresses through the one-way egress valve 34. The spring hinge 22 is open in this position. The ingress and egress valves are one-way valves and may be selected from a number of designs known to those skilled in the art.

Figure 4:
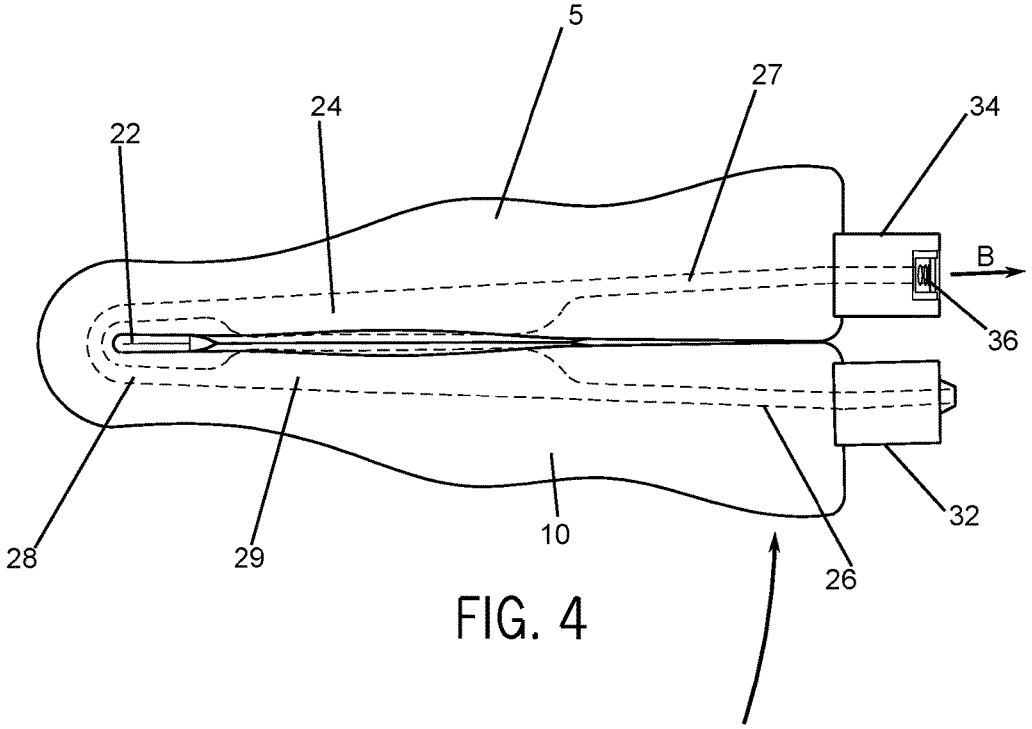
FIG. 4 is a side elevation view of the jaw-strengthening device in a closed position, according to an embodiment of the present invention.

With reference to FIG. 4, the jaw-strengthening device is shown in a closed position, wherein the mouth of the wearer is closed. In this position, the upper and lower chambers are compressed and the bladders 24, 29 therein are compressed. The air in the system passes from the lower bladder 29, through the terminal channel 28, into the upper bladder 24, through the upper channel 27 and egresses through the egress valve 34, along the airflow marked B. The egress valve provides varying resistance to the outflow of air, wherein the resistance is either preset or is adjustable through a mechanism such as a slide 38 and a series of ports 36. The spring hinge 22 is compressed in this position.

Figure 5:
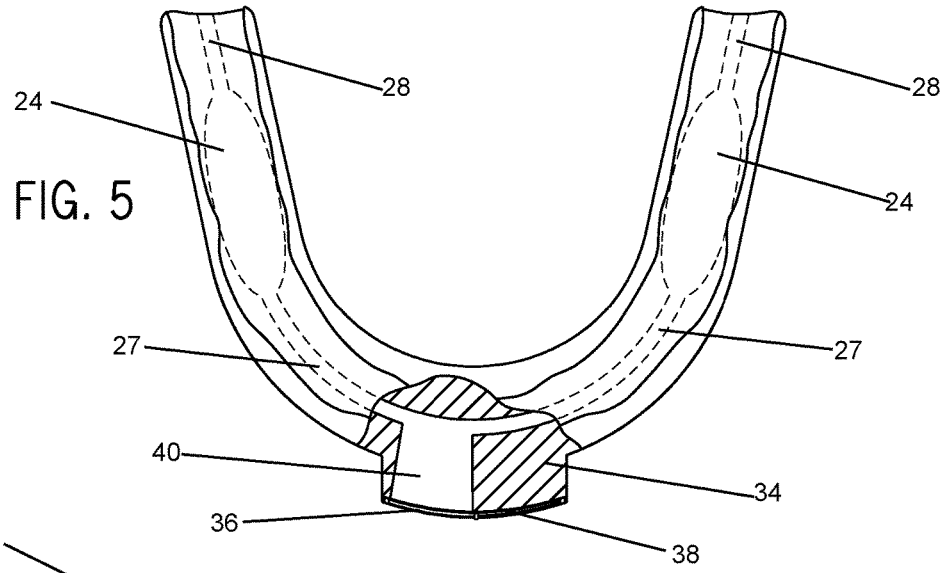
FIG. 5 is a top plan view of the jaw-strengthening device, according to an embodiment of the present invention.
Figure 6:
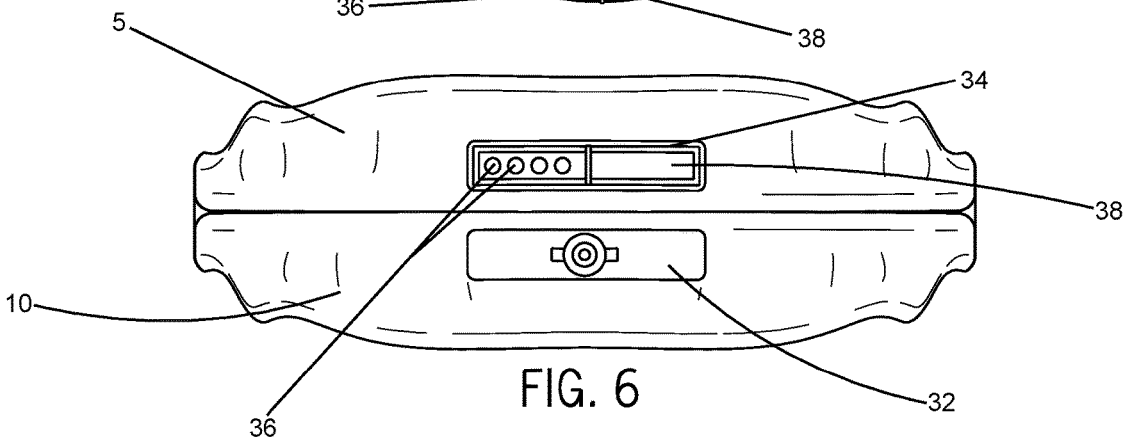
FIG. 6 is a front elevation view of the jaw-strengthening device in a closed position, according to an embodiment of the present invention.

With reference to FIGS. 5 and 6, a top view of the upper receiver 5 is shown, with a groove 6 for retaining the teeth running along the top. The upper bladders 5 on each side are shown in stippled lines, along with terminal channels 28 and upper channels 27. The egress valve 34 is shown in cutaway view wherein the upper channels 27 are connected to the valve opening 40, which communicates with the environment through a plurality of egress ports 36, which may be selectively blocked by slider 38.

Figure 7:
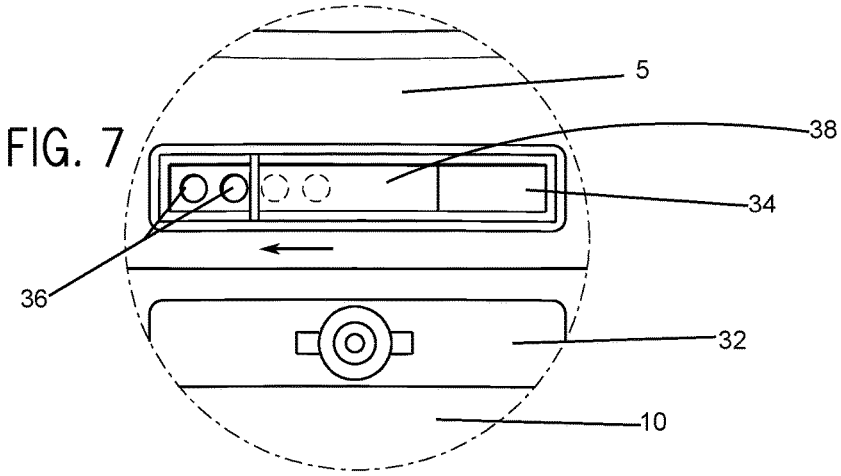
FIG. 7 is a detail view of the air ingress and egress valves of the jaw-strengthening device, according to an embodiment of the present invention.

With reference to FIG. 7, the valves 32, 34 are shown in detail view, and the slider 38 has been positioned over two of the four ports 36 in this embodiment increasing the resistance of air exiting the system as the jaw is clenched. The slider 38 moves within a track (not shown) and may be slid to block all ports 36 to increase resistance or leave all ports open to reduce resistance.

Figure 8:
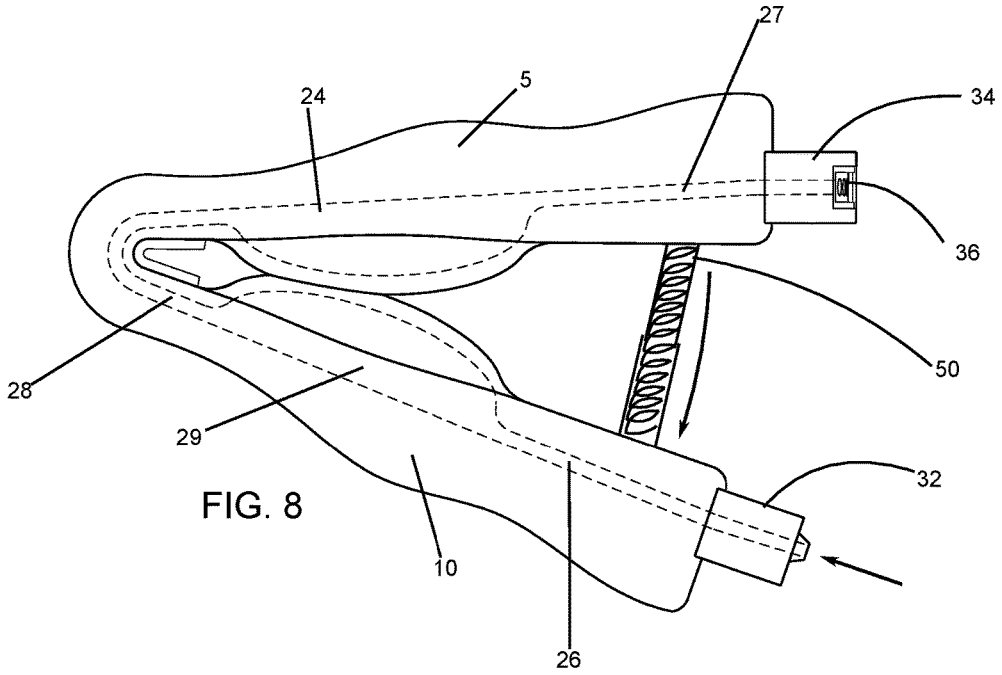
FIG. 8 is a side elevation view of the jaw-strengthening device in an open position, according to an embodiment of the present invention.
Figure 9:
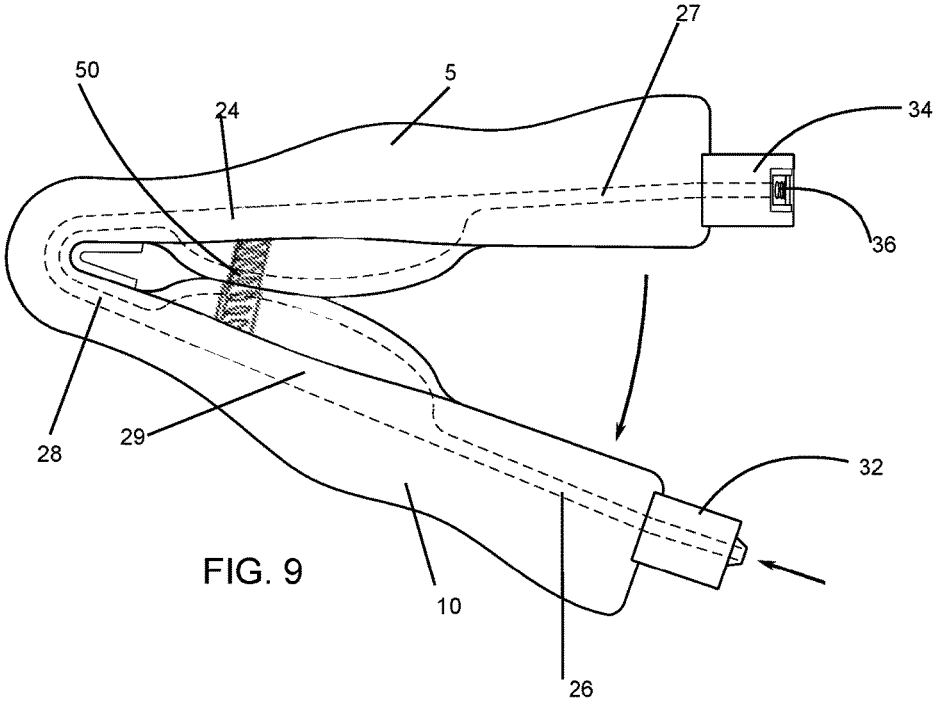
FIG. 9 is a side elevation view of the jaw-strengthening device in an open position, according to an embodiment of the present invention.

In an embodiment, the jaw-strengthening device is shown in an open position, wherein a piston 50 is shown biasing the device in the open position. One or more pistons are attached to the jaw-strengthening device such that force is required to overcome the biasing force of the piston to transition the device into the closed position. The placement of the piston 50 is shown wherein a single piston is towards the front of the device near the valves 32, 34 in FIG. 8 or a plurality of pistons are positioned near the mid-section or hinge section as in FIG. 9. In an alternative embodiment, one or more pistons 50 are used in combination with the spring hinge 22.

The jaw strengthener has the benefit of increasing fellatio performance and endurance, rehabilitating the jaw and corresponding muscles after a trauma such as a broken jaw/surgery or other injury, allowing musicians such as saxophone players to play longer with more comfortability, and decrease susceptibility to knock outs for fighters and athletes.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A jaw-strengthening device comprising:

a. a first receiver configured to receive a first row of teeth having first and second molar sections, the first receiver comprising:

i. a first air chamber within the first receiver positioned in a first molar section of the first receiver;

ii. a second air chamber within the first receiver positioned in a second molar section of the first receiver; and iii. an egress valve, configured to permit egress of air and prevent ingress of air, in communication with the first and second air chambers;

b. a second receiver configured to receive a second row of teeth having first and second molar sections, the second receiver comprising:

i. a third air chamber within the second receiver positioned in a first molar section of the second receiver;

ii. a fourth air chamber within the second receiver positioned in a second molar section of the second receiver; and c. an ingress valve, configured to permit ingress of air and prevent egress of air, in communication with the third and fourth air chambers, wherein the first and third air chambers are in communication, and wherein the second and fourth air chambers are in communication, wherein the egress valve has a plurality of resistance settings wherein the egress of air is restricted more for a higher resistance, and restricted less for a lower resistance, wherein the egress valve further comprises: a plurality of holes configured to permit the egress of air from the egress valve; and a slider configured to selectively cover the plurality of holes.

2. The jaw-strengthening device of claim 1, further comprising a lip guard positioned on an outside of the ingress valve, configured to retain a lip and prevent the lip from closing the ingress valve.

3. The jaw-strengthening device of claim 1, further comprising a lip guard positioned on an outside of the egress valve, configured to retain a lip and prevent the lip from closing the egress valve.

4. The jaw-strengthening device of claim 1, wherein the first and second receivers terminate in rear terminals, wherein the first and second receivers each have two opposing sides, and wherein the first and second receivers are connected at each respective side at the rear terminals, and wherein air channels pass through the rear terminals.

5. The jaw-strengthening device of claim 1, wherein the air chambers are resilient and open when no force is applied thereto.

6. The jaw-strengthening device of claim 1, wherein the air chambers form bladders to temporarily retain air.

7. The jaw-strengthening device of claim 1, wherein the first and second receivers are molded to fit the respective rows of teeth.

8. The jaw-strengthening device of claim 4, further comprising spring hinges connecting the rear terminals of the first and second receivers, wherein the spring hinges are configured to provide resistance.

9. The jaw-strengthening device of claim 1, further comprising one or more pistons in communication with the first and second receivers, wherein the one or more pistons are configured to provide resistance.

* * * * *